US010066466B2

(12) United States Patent
Radtke

(10) Patent No.: US 10,066,466 B2
(45) Date of Patent: Sep. 4, 2018

(54) DELIVERING PRESSURISED FLUID

(71) Applicant: MorphPackers Limited, Aberdeen (GB)

(72) Inventor: Cameron Hill Radtke, Aberdeen (GB)

(73) Assignee: MORPHPACKERS, LIMITED (GB)

( * ) Notice: Subject to any disclaimer, the term of this patent is extended or adjusted under 35 U.S.C. 154(b) by 0 days.

(21) Appl. No.: 15/674,011

(22) Filed: Aug. 10, 2017

(65) Prior Publication Data

US 2018/0051542 A1 Feb. 22, 2018

(30) Foreign Application Priority Data

Aug. 19, 2016 (GB) ..... 1614183.0

(51) Int. Cl.
*E21B 43/10* (2006.01)
*F15B 3/00* (2006.01)
*E21B 23/04* (2006.01)

(52) U.S. Cl.
CPC ..... *E21B 43/105* (2013.01); *E21B 23/04* (2013.01); *F15B 3/00* (2013.01)

(58) Field of Classification Search
CPC ... E21B 43/105; E21B 17/1014; E21B 19/163
See application file for complete search history.

(56) References Cited

U.S. PATENT DOCUMENTS 5,429,036 A * 7/1995 Latos ..... E21B 7/18 60/327
6,073,708 A * 6/2000 Brown ..... E21B 4/00 175/106
6,289,998 B1 * 9/2001 Krueger ..... E21B 7/18 175/107
7,017,670 B2 3/2006 Hazel et al.
2016/0097263 A1 * 4/2016 Thomson ..... E21B 23/04 166/384

FOREIGN PATENT DOCUMENTS

WO WO 2016/051169 A1 4/2016

* cited by examiner

*Primary Examiner* — David J Bagnell
*Assistant Examiner* — Jonathan Malikasim
(74) *Attorney, Agent, or Firm* — Law Office of Jesse D. Lambert, LLC

(57) ABSTRACT

A pressure intensifier and method of increasing fluid pressure at a desired location in a well bore. A central mandrel having a bore therethrough is affixed in a string. Surrounding the mandrel is a cylindrical body having stacked pistons. At a predetermined fluid pressure through the bore, the pistons release and are moved downwards, to integrate pressure across the pistons and act on a chamber pre-filled with application fluid. The application fluid is forced through delivery conduits at a higher pressure than the predetermined fluid pressure and may be used to morph a tubular. In an embodiment, the predetermined fluid pressure is field adjustable.

17 Claims, 1 Drawing Sheet

DELIVERING PRESSURISED FLUID

Figure 1:
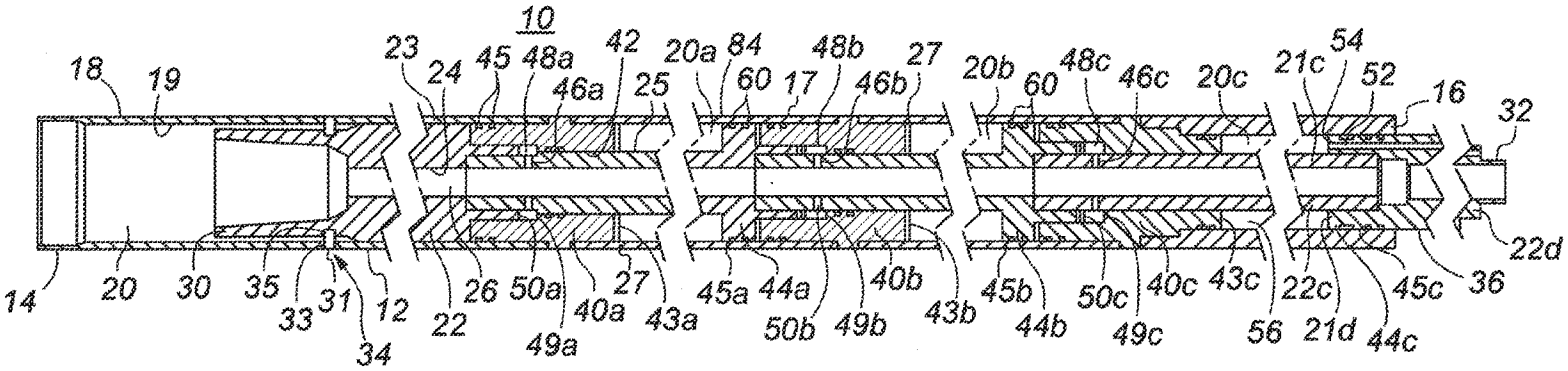

The present invention relates to an improved apparatus and method for delivering pressurised fluid to a predetermined location in a downhole environment.

Oil or gas wells are conventionally drilled with a drill string at which point the open hole is not lined, hereinafter referred to as a "borehole". After drilling, the oil, water or gas well is typically completed thereafter with a casing or liner and a production tubing, all of which from here on are referred to as a "tubular".

Morphing technology has been developed wherein a portion of a metal tubular is forced radially outwardly by the use of fluid pressure acting directly on the internal surface of the tubular. Sufficient hydraulic fluid pressure is applied to move the tubular metal portion radially outwards and cause the tubular metal portion to morph itself onto a generally cylindrical structure in which it is located. The portion undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed tubular metal portion. During the morphing process, both the inner and outer surfaces of the tubular metal portion will take up the shape of the surface of the wall of the cylindrical structure. This morphed tubular is therefore ideally suited for creating a seal between tubulars in a wellbore or between a tubular and an open borehole wall. The morphed tubular metal portion may also be a sleeve if mounted around a supporting tubular body, being sealed at each end of the sleeve to create a chamber between the inner surface of the sleeve and the outer surface of the body. A port is arranged through the body so that fluid can be pumped into the chamber from the throughbore of the body. This morphed isolation barrier is ideally suited for creating a seal between a tubular string and an open borehole. An example of a packer using this technology is described in WO2016/055775.

Fluid at a high pressure must be delivered to the location of the tubular metal portion in order to morph it. It will be appreciated that the location may be thousands of feet in depth and thus pumping fluid from the surface will have drawbacks in that, the fluid pressure will reduce with depth and cannot be adequately calculated to ensure sufficient morphing pressure is reached. Additionally, it may not be desirable to pump such high fluid pressure through the tubing string for many well designs.

Hydraulic fluid delivery tools have been developed which can be run into a string from surface by means of coiled tubing or other suitable method. The tool is provided with upper and lower seals, which are operable to radially expand and seal against the inner surface of the string at a pair of spaced apart locations in order to isolate an internal portion of the string between the seals at the desired location. Fluid at high pressure can then be delivered to the location via a port in fluid communication with the interior of the string. An example of a hydraulic fluid delivery tool is described in U.S. Pat. No. 7,017,670.

For deep water projects a pressure intensifier is typically coupled to the hydraulic fluid delivery tool to increase the fluid pressure for morphing. An example of a pressure intensifier is described in WO2016/051169. However, for purposes of reliability, it is desirable to minimize the number of component parts to minimize complexity to manufacture and risk failure.

It is an object of the present invention to provide a pressure intensifier for delivering pressurised fluid to a location downhole which obviates or mitigates at least some of the disadvantages of the prior art.

According to a first aspect of the invention there is provided a pressure intensifier, the pressure intensifier comprising:

- an elongate mandrel defining an inner bore into which fluid is delivered, the mandrel being co-axially located within an elongate hollow outer cylindrical body;
- at least one annular piston extending inwardly from the cylindrical body across the annular bore to the mandrel and shaped such that a discreet fluid receiving void is created between an active surface of the piston and the elongate mandrel;
- at least one input port to enable fluid communication between the inner bore and the fluid receiving void;
- at least one stop located on an outer surface of the mandrel to limit travel of each piston;
- morph fluid located in a chamber of the annular bore between an opposing surface of a first piston and a first stop;
- wherein at least one delivery port exits the chamber to deliver the morph fluid at a greater pressure than the pressure of fluid delivered through the inner bore.

In this way, a fluid pumped under pressure down the inner bore will create a force used to move the at least one piston which in turn causes delivery of a morph fluid at increased pressure to achieve morphing of a tubular downhole. By having the pistons integrated with the outer cylinder and thus causing the outer cylinder arrangement to move relative to the mandrel, the mandrel can be fixed to an upper sub on a string, thereby presenting a throughbore which only requires the input ports. This simplifies construction and reduces the likelihood of leakage between components thus increasing operational efficiency of the pressure intensifier tool.

Preferably, there is a plurality of pistons arranged along the cylindrical body. In this way, as the total force is the sum of force from all the pistons, the pressure of the morph fluid can be increased without increasing the pressure of fluid pumped downhole. Additionally, this arrangement allows the morph to be completed on a single stroke.

Preferably the plurality of pistons and the outer cylindrical body are secured together and form a pressure development mechanism which can move relative to the mandrel. By retaining the mandrel in a fixed position and moving the pressure development mechanism, the efficiency of the pressure intensifier is increased by minimisation of the development of leak paths causing pressure loss. In addition, provision of the moving parts mounted in an annular arrangement around a fixed mandrel means that the tool is easier to assemble i.e. it can be constructed in a 'top down' configuration.

Preferably, the delivery ports exiting the chamber form delivery conduits having an inner diameter less than the inner diameter of the annular bore between each adjacent piston and stop. Having delivery conduits of a narrower bore than that of the annular bore causes a further increase in pressure in the morph fluid delivered along the delivery conduits.

Preferably, the intensifier includes a locking mechanism, the locking mechanism being arranged to hold the pressure development mechanism in a first position until a morph is required. In this way, fluids can be delivered through the inner bore for other operations without causing morphing to occur. Advantageously, the locking mechanism is releasable at a predetermined fluid pressure applied through the mandrel. More preferably, the predetermined fluid pressure for release can be adjustable. In this way, the fluid pressure for release can be set in the field when other operable fluid pressures in the well will be known.

Preferably, the locking mechanism is at least one shear pin which secures the pressure development mechanism in a predetermined position at an entry end of the pressure intensifier. Use of a shear pin locking mechanism enables the pressure development mechanism only to be actuated simply by provision of sufficient hydraulic pressure when actuation is required. Advantageously, the locking mechanism is accessible from an outer surface of the tool. In this way, the pressure to shear the pin and activate the tool, can be selected at any time dependent upon the pressure required to activate other tools being used in the well.

Preferably, a hydraulic fluid delivery tool is provided at an output end of the pressure intensifier, the hydraulic fluid delivery tool being operable to receive morph fluid from the pressure intensifier and deliver it to a location where a high pressure fluid is required.

More preferably, the delivery conduits are arranged to deliver the morph fluid directly to a desired location. In this way, by stroking the tool, morphing can be achieved quickly and in a single stoke.

Additionally, the delivery ports may be arranged to deliver morph fluid to a hydraulic fluid delivery tool which provides morph fluid under pressure to operate upper and lower seals prior to delivering morph fluid to the location. In this way, a hydraulic fluid delivery tool or morph tool can be entirely operated in a single stroke.

According to a second aspect of the present invention there is a method of intensifying pressure of fluid for delivery to a location, comprising the steps:

a) providing a pressure intensifier according to the first aspect;
b) positioning the pressure intensifier such that pressurised fluid will be output at a location in the tubular;
c) flowing fluids through the inner bore of the pressure intensifier;
d) passing fluid through the input port(s) into the fluid receiving void(s) to apply a pressure upon the active surface(s) of the piston(s);
e) forcing the outer cylindrical body and the piston(s) to move along the mandrel until each piston reaches a stop;
f) driving morph fluid out of the delivery conduit(s) at a desired morph pressure by movement of the first piston towards the first stop; and
g) delivering morph fluid to the desired location.

In this way, fluid pressure pumped downhole creates a force to move the pistons relative to the mandrel, which then creates a pressure of fluid which, if required to, could be used to morph a tubular.

Preferably, the method includes the step of selecting a number of pistons dependent upon the morph pressure required. In this way, morphing the tubular is achieved on a single stroke of the outer cylindrical body and piston arrangement.

Preferably, the method includes the step of retaining the outer cylindrical body and piston arrangement in a first position while delivering fluid through the inner bore. In this way, fluid under pressure is available in the wellbore for other purposes prior to operating morph tools.

Preferably, the method includes the step of retaining the outer cylindrical body and piston arrangement in a first position while running a further string through the inner bore. In this way, other intervention such as the running of tools can be achieved while the pressure intensifier is in the wellbore.

Preferably, the method includes the steps of:

a) providing a pressure releasable locking mechanism to secure the outer cylindrical body and piston arrangement to the mandrel;
b) setting a release pressure on the pressure releasable locking mechanism at surface;
c) causing release of the outer cylindrical body and piston arrangement by applying fluid pressure in the inner bore at the release pressure to cause the release of the piston arrangement from the outer cylindrical body; and
d) operating the pressure intensifier on fluid pressure in the inner bore.

In this way, activation pressure of the pressure intensifier can be selected by a user in the field so that the pressure intensifier can be used in a well in which other pressure activated tools are present.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

Figure 2:
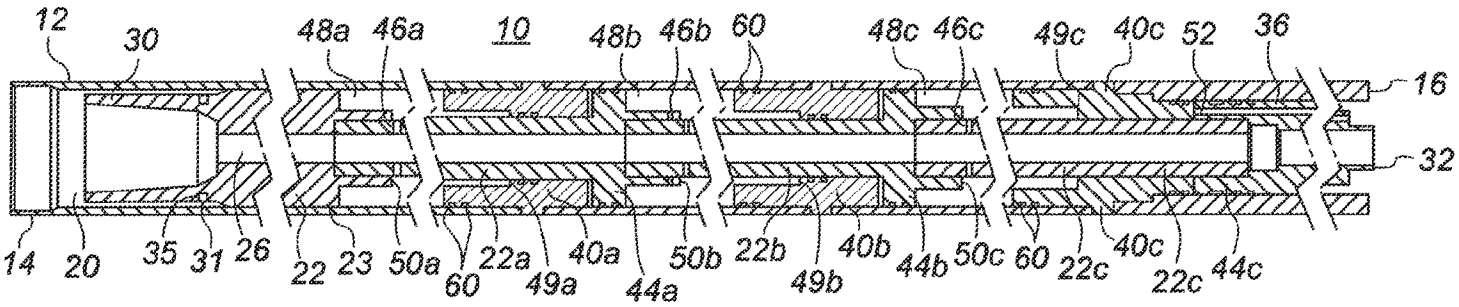

Embodiments of the present invention will now be described, by way of example only, with reference to the accompanying drawings in which:

FIG. 1 is a cross-section of a pressure intensifier in a first state according to an embodiment of the present invention; and FIG. 2 is a cross-section of the pressure intensifier of FIG. 1 in a second state according to an embodiment of the present invention;

Referring initially to FIG. 1 there is shown a longitudinal cross-section of a pressure intensifier, generally indicated by reference numeral 10, for use in providing pressurised fluid to a predetermined location within a wellbore.

The pressure intensifier 10 comprises a cylindrical body 12 provided with a first end 14, a second end 16 with a central length 17 therebetween formed by an outer cylindrical wall 18.

Cylindrical body 12 is of metal construction and is a substantially hollow tubular having a cylindrical wall 18 with an inner surface 19 defining a bore 20 therethrough. Within bore 20 is arranged co-axially a cylindrical mandrel 22, also of metal construction, having an outer surface 23 and an inner surface 24 that defines an inner bore 26. Mandrel 22 is further provided with a first end 30 and a second end 32, the ends 30, 32 are provided with suitable fittings as are known in the art for connecting the tool 10 into a string not shown for running the tool 10 into a wellbore. Suitable strings may be coiled, tubing, drill pipe, liner and the like. The mandrel 22 is thus fixed on a string. The second end 32 can be attached to a hydraulic fluid delivery tool.

Arranged within bore 20 at first end 14 of the cylindrical body 12 is a locking mechanism 34 which in this case comprises shear pins that extend through openings 33 in the cylindrical wall 18 and are received in recesses 35 formed in the first end 30 of mandrel 22. The shear pins 34 secure the cylindrical body 18 and mandrel 22 relative to one another. The shear pins can be removable inserted into the recesses 35 through openings 33 such that the pins 34 used can be provided at different strengths so that a suitable pin is used depending on the environment in which the tool is deployed and the level of fluid pressure which will pass through the bore 26 in general operation as well as the level of fluid pressure required to actuate the pressure intensifier 10.

A pressure development mechanism 84 is formed from the first end 14 along the central length 17 of the cylindrical body 12 with pistons 40 provided at intervals along the central length 17. A pressure application mechanism 36 is formed at the second end 32 of the mandrel 22.

In the pressure development mechanism 84, the central mandrel 22 continues co-axially through cylindrical body 12. The cylindrical body 12 is provided along its central portion 17 with actuating pistons 40. In the embodiment show, the mechanism 84 is provided with two actuating pistons 40*a, b* and a high pressure piston 40*c* with each piston 40*a, b, c* associated with a segment of mandrel 22*a-c* respectively. The pistons 40*a, b, c* are spaced apart along, and project perpendicularly inwards from the cylindrical wall 18. Each piston 40*a, b, c* is substantially annular and extends across bore 20 such that a movable seal is formed between internal piston surface 42 and recessed portion 25 of outer surface 23 of mandrel 22.

The pressure development mechanism 84 further includes annular stop mechanisms 44 which are spaced equidistantly apart and project from the outer surface 23 of mandrel 22. In the embodiment shown, two annular stop mechanisms 44*a, b* are provided projecting from the from the outer surface 23 of mandrel portions 22*a* and 22*b* respectively such that a movable seal is formed between inner surface 19 of the cylindrical body 12 and the projected surfaces 45*a*, 45*b* of the mandrel stops 44*a*, 44*b*. The third annular stop mechanism 44*c* is formed by the active surface 45*c* of the pressure application mechanism 36. Each annular stop mechanism 44 is static and fixed relative to the end 30. Thus the stop mechanisms 44 and mandrel 22 does not move within the string.

The mandrel 22 is further provided with ports 46 spaced apart along the length of the mandrel. In this case, three ports 46*a*, 46*b* and 46*c* are provided. The ports 46*a,b,c* enable fluid communication between the mandrel bore 26 and voids 48*a*, 48*b*, 48*c* defined between an active surface 49 of pistons 40, a void defining surface 50 and recess surface 25 of outer surface 23 of the mandrel 22.

Between the leading face 43*a, b, c* of the pistons 40*a, b, c*, stop mechanisms 44*a, b, c*, recessed outer surface 25 of mandrel 22 and inner surface 19 of cylindrical body 22, there are further defined annular voids 20*a*, 20*b*, 20*c*. Each of annular voids 20*a*, 20*b* is provided with a port 27 which extends through wall 18 of body 12.

In the pressure application mechanism 36 the mandrel 22 is provided with a segment 22*d* having a cylindrical wall 21*d* that overlaps cylindrical wall 21*c* of segment 22*c* in a manner which causes it to extend annularly across bore section 20*c* such that a movable seal is formed between surface 23*d* and 19*d*. The thickness of the mandrel wall 23 where segments 22*c* and 22*d* overlap provides additional resilience to pressure created by the intensifier tool. A delivery conduit 52 is defined longitudinally through cylindrical wall 21*d* of pressure application mechanism 36 such that it is parallel to bore 26. A delivery port 54 allows fluid communication between void 20*c* and delivery conduit 52. The delivery conduit 52 is operable then to provide fluid communication between annular void 20*c* and a desired location (not shown). The diameter of the fluid delivery conduit 52 is less than the diameter or annular void 20*c* which, in turn, is less than the diameter of annular voids 20*a* and 20*b*. The annular void 20*c* is provided with application fluid 56, which may be any suitable fluid including, for example, clean water.

The pressure intensifier 10 is operable to have two states. In the first state, the components of the intensifier are arranged in a first position as is shown in the embodiment illustrated in FIG. 1. The intensifier 10 is in a first state prior to actuation of the mechanism 36 to apply pressure to a tool (not shown).

In the first state, the first end 14 of the body 12 is arranged such that it extends longitudinally away from first end 30 of mandrel 22 and is secured in position by retaining mechanism 34. End 30 is attached to a sting providing a continuous central bore 26 through the pressure intensifier 10. The pressure application mechanism 36 extends longitudinally beyond the second end 16 of cylindrical body 12.

The inner surface 19, outer surface 24, actuating piston 40*a* and mandrel void defining surface 50*a* co-operate in the first state so as to form a chamber 48*a*. The first actuating piston 40*a* is arranged so that it is spaced remotely along the bore 20 from stop 44*a*. The actuating piston 40*a*, inner surface 19, outer surface 25 and stop 44*a* co-operate in the first state to form a chamber 20*a*.

Similarly, the actuating piston 40*b* is arranged spaced remotely along the bore 20 from stop 44*b*. The actuating piston 40*b*, void defining surface 50*b*, outer surface 25 and stop 44*a* co-operate in the first state to form a chamber 48*b*. The actuating piston 40*b*, inner surface 19, outer surface 25 and stop 44*b* co-operate in the first state to form a chamber 20*b*.

High pressure piston 40*c* is arranged mounted projecting inwardly from cylinder 12 such that in a first state it is closely adjacent to stop 44*b* and defines chamber 48*c*. The high pressure piston 40*c*, outer surface 25, void defining surface 50*c* and fluid facing face 54 of bore stop 44*c* co-operate in the first state to form a sealed chamber 20*c* which is filled with morph fluid 56.

Each co-operating mandrel and cylindrical body or piston surface is provided with a resilient seal ring 60 such as a rubber or elastomeric o-ring or similar, that provides a resilient seal between the adjacent surfaces. The seal rings 60 allow lateral movement between the mandrel surfaces and the inner wall and piston surfaces whilst preventing the passage of fluid therebetween.

Each piston 40 may be integrally formed with mandrel 22 or is attached to the cylindrical body segments by a screw mechanism such that the pistons 40 act as joining mechanisms between adjacent cylindrical body segments. This enables the cylindrical body and piston arrangement to be constructed, and built up from the bottom of, a mandrel secured in position.

Upon actuation, the moveable components of intensifier 10, namely, the components of the cylindrical body 12 and piston arrangement, through the process of receiving and applying fluid under pressure, move to a second state. The arrangement of the components in the second state is shown in FIG. 2.

In use, the pressure intensifier is connected on a string at end 30 and a hydraulic fluid delivery tool is connected at end 36 of the mandrel 22. A determination is made as to the maximum fluid pressure which is likely to be applied through the string when the tool 10 is in the wellbore and activation is not required. The shear pins 34 are then selected to shear at a greater pressure than the maximum fluid pressure calculated. The shear pins 34 can then be arranged in the locking mechanism. If a maximum pressure is not expected then a nominal pressure rating of shear pin can be used. The selection of the shear pin rating can be done in the field.

The tool 10 is then run in the wellbore whereupon fluid in the bore 26 enters ports 46 to fill the chambers 48. Additional fluid outside the string will fill the chambers 20. The tool 10 will not activate and no components will move until the pressure of fluid entering the ports 46 is sufficient to shear the pins 34. The hydraulic fluid pressure entering the ports 46 acts on the active surface 50 of the pistons 40 and when this is greater than the shear pressure on the pins 34, these will shear releasing the cylindrical body 12 and piston arrangement 40. Consequently the voids 48 will increase in size as the pistons 40 move longitudinally downwards over the mandrel 22.

As the pistons 40 move downwards, chambers 20 will reduce in size as the volume of each void decreases. Fluid in the chambers 20 will be forced out of the tool 10 through ports 27. Chamber 20*c* does not include a port 27 and instead, the exit of fluid is through the delivery conduit 52. The fluid is the morph fluid sealed in the chamber 20*c* before activation. High pressure piston 44*c* thus acts upon the morph fluid 56 and forces the fluid 56 into the delivery conduit 52 for use in the hydraulic fluid delivery tool mounted below.

In FIG. 2, the arrangement of the components of intensifier 10 are shown in a second state, subsequent to activation according to an embodiment of the invention. In this embodiment, outer cylindrical body 12 has been driven forward as has pistons 40*a,b* such that they now abut against stops 44*a,b* respectively and high pressure piston 44*c* has been driven forward to abut against wall end stop 54. The force created by hydraulic pressure acting upon pistons 40*a,c* cumulatively acts upon application piston 44*c* such that the fluid 56 is driven through delivery conduit 52 with such a force that it is capable of performing a tubular morphing operation with a single actuation of the mechanism.

The cumulative pressure against pistons 40*a,b* creates a total force applied to fluid 56 by the movement of piston 44*c* which is the sum of force from all the pistons 40*a,b*. The increased thickness of overlapped walls 22*c, d* 18*c* enables the force of pressure applied to the conduit 52 to be directed to a desired location without damaging or causing deformation of the pressure intensifier 10.

The number of pressure development segments used in the pressure intensifier 10 can be varied depending upon the level of pressure required for a particular use of the intensifier; the more pressure development segments in the form of pistons 40, outer cylindrical segments 12 and stops 48 included in the intensifier 10, the more pressure will can be applied from the mechanism 10. Fewer segments and pistons will result in a lower pressure being applied by the mechanism 10.

The principle advantage of the present invention is that it provides a pressure intensifier which uses a force created downhole to generate pressure which can be applied to a downhole location as desired.

A further advantage of the present invention is that by mounting the movable components of the outer cylinder and pistons on a fixed mandrel, the intensifier mechanism can be constructed from the first end 14, or top down.

A further advantage of the present invention is that by providing locking mechanisms that are easily accessible and simple to swap out for different strength components, the intensifier mechanism can easily be adapted for different applications in the field.

It will be appreciated by those skilled in the art that modifications may be made to the invention herein described without departing from the scope thereof. For example, the posts 46 are shown in the above embodiments as small round holes through the mandrel 20. However, the instead of a single hole, each port may comprise a plurality of holes, or the port may be shaped as a slit, a slot or a plurality of slots formed around the circumference of the mandrel 20. The pistons and stops may also have different shapes and configurations.

I claim:

1. A pressure intensifier, the pressure intensifier comprising:

an elongate mandrel defining an inner bore into which pumped fluid is delivered, the mandrel being co-axially located within an elongate hollow outer cylindrical body;

at least one annular piston extending inwardly from the cylindrical body across an annular bore to the mandrel and shaped such that a discreet fluid receiving void is created between an active surface of the piston and the elongate mandrel;

at least one input port to enable fluid communication between the inner bore and the fluid receiving void and thereby move the piston;

at least one stop located on an outer surface of the mandrel to limit travel of each piston when fluid enters the void, the at least one stop being static;

morph fluid, distinct from the pumped fluid, located in a chamber of the annular bore between an opposing surface of a first piston and a first stop;

wherein at least one delivery port exits the chamber to deliver the morph fluid at a greater pressure than the pressure of pumped fluid delivered through the inner bore.

2. A pressure intensifier according to claim 1 wherein there is a plurality of pistons arranged along the cylindrical body.

3. A pressure intensifier according to claim 1 wherein the plurality of pistons and the outer cylindrical body are secured together and form a pressure development mechanism which can move relative to the mandrel.

4. A pressure intensifier according to claim 3 wherein the intensifier includes a pressure releasable locking mechanism, the locking mechanism being pressure adjustable and the locking mechanism being arranged to hold the pressure development mechanism in a first position until a morph is required.

5. A pressure intensifier according to claim 4 wherein the locking mechanism is at least one shear pin which secures the pressure development mechanism in a predetermined position.

6. A pressure intensifier according to claim 4 wherein the locking mechanism is accessible from an outer surface of the tool to adjust the pressure for release.

7. A pressure intensifier according to claim 1 wherein the at least one delivery port exiting the chamber forms delivery conduits having an inner diameter less than the inner diameter of the annular bore between each adjacent piston and stop.

8. A pressure intensifier according to claim 1 wherein a hydraulic fluid delivery tool is provided at an output end of the pressure intensifier, the hydraulic fluid delivery tool being operable to receive morph fluid from the pressure intensifier and deliver it to a location where a high pressure fluid is required.

9. A method of intensifying pressure of fluid for delivery to a location, comprising the steps:

(a) providing a pressure intensifier comprising:

an elongate mandrel defining an inner bore into which pumped fluid is delivered, the mandrel being co-axially located within an elongate hollow outer cylindrical body;

at least one annular piston extending inwardly from the cylindrical body across an annular bore to the mandrel and shaped such that a discreet fluid receiving void is created between an active surface of the piston and the elongate mandrel;

at least one input port to enable fluid communication between the inner bore and the fluid receiving void and thereby move the piston;

at least one stop located on an outer surface of the mandrel to limit travel of each piston when fluid enters the void, the at least one stop being static;

morph fluid, distinct from the pumped fluid, located in a chamber of the annular bore between an opposing surface of a first piston and a first stop;

wherein at least one delivery port exits the chamber to deliver the morph fluid at a greater pressure than the pressure of pumped fluid delivered through the inner bore;

(b) positioning the pressure intensifier such that pressurised morph fluid will be output at a location in a tubular;

(c) pumping fluids through the inner bore of the pressure intensifier;

(d) passing pumped fluid through the input port(s) into the fluid receiving void(s) to apply a pressure upon the active surface(s) of the piston(s);

(e) forcing the outer cylindrical body and the piston(s) to move along the fixed mandrel until each piston reaches a stop;

(f) driving morph fluid out of the delivery conduit(s) at a desired morph pressure by movement of the first piston towards the first stop; and (g) delivering morph fluid to the desired location.

10. The method according to claim 9 including the step of selecting a number of pistons dependent upon the morph pressure required.

11. The method according to claim 9 including the step of setting a release pressure of the intensifier via a pressure releasable locking mechanism accessible from an outer surface of the intensifier.

12. The method according to claim 11 including the steps of:

a) setting the release pressure on the pressure releasable locking mechanism at surface;

b) causing release of the outer cylindrical body and piston arrangement by applying fluid pressure in the inner bore at the release pressure to cause the release of the piston arrangement from the outer cylindrical body; and c) operating the pressure intensifier on fluid pressure in the inner bore.

13. The method according to claim 9 including the step of retaining the outer cylindrical body and piston arrangement in a first position while running a further string through the inner bore.

14. A pressure intensifier, the pressure intensifier comprising:

an elongate mandrel defining an inner bore into which fluid is delivered, the mandrel being co-axially located within an elongate hollow outer cylindrical body;

at least one annular piston extending inwardly from the cylindrical body across the annular bore to the mandrel and shaped such that a discreet fluid receiving void is created between an active surface of the piston and the elongate mandrel;

at least one input port to enable fluid communication between the inner bore and the fluid receiving void and thereby move the piston;

at least one stop located on an outer surface of the mandrel to limit travel of each piston when fluid enters the void, the at least one stop being static;

morph fluid located in a chamber of the annular bore between an opposing surface of a first piston and a first stop;

wherein at least one delivery port exits the chamber to deliver the morph fluid at a greater pressure than the pressure of fluid delivered through the inner bore;

wherein the plurality of pistons and the outer cylindrical body are secured together and form a pressure development mechanism which can move relative to the mandrel; and the intensifier includes a pressure releasable locking mechanism, the locking mechanism being pressure adjustable and the locking mechanism being arranged to hold the pressure development mechanism in a first position until a morph is required.

15. A pressure intensifier according to claim 14 wherein the locking mechanism is at least one shear pin which secures the pressure development mechanism in a predetermined position.

16. A pressure intensifier according to claim 14 wherein the locking mechanism is accessible from an outer surface of the tool to adjust the pressure for release.

17. A method of intensifying pressure of fluid for delivery to a location, comprising the steps:

(a) providing a pressure intensifier comprising:

an elongate mandrel defining an inner bore into which fluid is delivered, the mandrel being co-axially located within an elongate hollow outer cylindrical body;

at least one annular piston extending inwardly from the cylindrical body across an annular bore to the mandrel and shaped such that a discreet fluid receiving void is created between an active surface of the piston and the elongate mandrel;

at least one input port to enable fluid communication between the inner bore and the fluid receiving void and thereby move the piston;

at least one stop located on an outer surface of the mandrel to limit travel of each piston when fluid enters the void, the at least one stop being static;

morph fluid located in a chamber of the annular bore between an opposing surface of a first piston and a first stop;

wherein at least one delivery port exits the chamber to deliver the morph fluid at a greater pressure than the pressure of fluid delivered through the inner bore;

(b) positioning the pressure intensifier such that pressurised fluid will be output at a location in a tubular;

(c) flowing fluids through the inner bore of the pressure intensifier;

(d) passing fluid through the input port(s) into the fluid receiving void(s) to apply a pressure upon the active surface(s) of the piston(s);

(e) forcing the outer cylindrical body and the piston(s) to move along the fixed mandrel until each piston reaches a stop;

(f) driving morph fluid out of the delivery conduit(s) at a desired morph pressure by movement of the first piston towards the first stop;

(g) delivering morph fluid to the desired location; and wherein the method includes the step of selecting a number of pistons dependent upon the morph pressure required.

* * * * *